US006431109B1

(12) United States Patent
Martin

(10) Patent No.: US 6,431,109 B1
(45) Date of Patent: Aug. 13, 2002

(54) BIG GAME FISHING CHAIR

(76) Inventor: Eugene G. Martin, 840 S. Cocalico Rd., Denver, PA (US) 17517

( * ) Notice: Subject to any disclaimer, the term of this patent is extended or adjusted under 35 U.S.C. 154(b) by 0 days.

(21) Appl. No.: 09/621,573

(22) Filed: Jul. 21, 2000

Related U.S. Application Data

(60) Provisional application No. 60/146,992, filed on Aug. 3, 1999.

(51) Int. Cl.[7] ..... B63B 17/00
(52) U.S. Cl. ..... 114/363; 297/344.12
(58) Field of Search ..... 114/363; 297/344.12, 297/344.22, 338, 339

(56) References Cited

U.S. PATENT DOCUMENTS

| | | | | |
|---|---|---|---|---|
| 3,851,916 A | | 12/1974 | Quartullo | 297/188 |
| 4,086,676 A | | 5/1978 | Arruza | 9/7 |
| 4,879,963 A | | 11/1989 | Dionne | 114/363 |
| 5,297,849 A | * | 3/1994 | Chancellor | 297/344.12 |
| 5,647,161 A | | 7/1997 | Miller | 43/21.2 |

* cited by examiner

*Primary Examiner*—Jesus D. Sotelo
(74) *Attorney, Agent, or Firm*—Miller Law Group PLLC

(57) ABSTRACT

A big game fishing chair provides a rocking action to enhance the rod movement while fighting big game fish. The rocking action is controlled by the legs of the operator, which lessens fatigue. The rocking mechanism includes a casting that is supported on the rotational mount of a standard pedestal. The chair is supported on the casting by two pairs of front and rear pivot links that are angled toward one another to provide the desired pivotal action for the chair relative to the pedestal which is fixed to the boat deck. The rocking action supplied by the rocking mechanism, between a full rearward position and a full forward position, provides arcuate movement to the fishing rod with requiring any traditional movement supplied to the fishing rod through the pivotal movement of the rod holder. A locking mechanism is operable to fix the rocker mechanism in a non-pivoting configuration to prevent the rocking mechanism from being operable, thus disabling the rocking action while the chair is not in use.

24 Claims, 12 Drawing Sheets

BIG GAME FISHING CHAIR

CROSS-REFERENCE TO RELATED APPLICATIONS

This application claims domestic priority on co-pending U. S. Provisional Patent Application Serial No. 60/146,992, filed Aug. 3, 1999, the contents of which are incorporated herein by reference.

BACKGROUND OF THE INVENTION

This invention relates generally to big game fishing chair mounted on a boat from which a fisherman will fight a big game fish and, more particularly, to a rocking mechanism interposed between a standard fishing chair and pedestal mount to enhance the operation of the chair.

Big game fishing chairs are mounted on the stern or aft deck of a boat to provide a station from which a fisherman can fight and land a big game fish, such as a blue marlin, sailfish, swordfish and the like. The conventional fishing chair has a seat, a back rest, a foot rest, and a pivoted rod holder for receiving the fishing rod. All of this structure is typically mounted on a pedestal for rotational movement about a generally vertical axis to enable the chair to swivel with the movement of the big game fish as it moves about beneath the surface of the water relative to the boat. The conventional fishing chair requires the fisherman to brace against the foot rest and pull backward on the fishing rod to pull the big game fish toward the boat. This action is quite strenuous and can require a significant amount of time, e.g. 4 to 8 hours, to land a big game fish. Even for muscular fishermen, this activity is tiring, particularly on the arms and back of the fisherman.

It has been recognized that it is preferable to use the leg muscles, being the strong muscles of the human body, in the fighting of big game fish. U.S. Pat. Nos. 4,086,676 and 3,851,916, for example, have been granted for big game fishing chairs incorporating a sliding mechanism for the seat so that the fisherman can push against the foot rest and, using his leg muscles, slide the seat portion rearwardly relative to the rod holder to effect a rearward movement of the fishing rod to fight the big game fish. Such devices, however, do not effect a pivotal movement of the rod holder, and the supported fishing rod, without the fisherman pulling rearwardly with his arms and back on the fishing rod. While such seat sliding mechanisms divide the effort between the legs, arms and back, the effort remains quite strenuous.

Another prior art apparatus to enhance the effectiveness of a big game fishing chair by providing a mechanism for utilizing the leg muscles of the fisherman can be found in U.S. Pat. No. 5,647,161. This apparatus involves a complicated lever and linkage mechanism operatively connected to the rod holder to permit the angler to effect pivotal movement of the rod holder relative to the chair by using leg muscles pressing against a sliding foot rest. Such linkage apparatus is complicated and can be quite dangerous if not used properly in that a big game fish can cause a sudden movement of the foot rest and connected linkage through the fishing rod mounted in the rod holder if the linkage is not properly seated. Furthermore, such linkage does not interconnect with the seat and back rest of the fishing chair.

Furthermore, these known prior art devices require specially manufactured chairs, supports, linkages, etc. which are not readily adaptable to standard fishing chairs on currently available boats. As a result, existing fishing chair structures could not be modified within the scope of the known prior art to enable the owner of an existing fishing chair to take advantage of these features without undertaking considerable expense and structural modifications.

It would be desirable to provide a big game fishing chair that would effect pivotal movement of the rod holder with an exertion of the fisherman's legs, while allowing the use of the upper body to effect yet further pivotal movement of the rod holder for fighting big game fish. It would be further desirable that such an improvement to a big game fishing chair be adaptable to existing fishing chairs without requiring substantial expense and modification.

SUMMARY OF THE INVENTION

It is an object of this invention to provide a big game fishing chair that is capable of rocking to enhance the operation thereof in catching big game fish.

It is an advantage of this invention that the rocking big game fishing chair utilizes the leg muscles of the operator to fight big game fish.

It is a feature of this invention that a greater arc of pivotal movement is possible for a fishing rod when using the rocking action of the big game fishing chair as the pivotal rocking movement of the chair is added to the pivotal movement of the rod holder.

It is another feature of this invention that the rocking mechanism for the big game fishing chair is supported on a pedestal that incorporates a rotational mechanism so that the rocking motion can be aligned with the position of the big game fish.

It is another advantage of this invention that a big game fisherman is less fatigued when using the rocking action of the instant invention to fight big game fish.

It is another object of this invention to provide a rocking mechanism that can be interposed between a standard big game fishing chair and a standard pedestal mount.

It is still another feature of this invention that the rocking mechanism of the instant invention can be used to convert a standard big game fishing chair to a rocking action version.

It is still another advantage of this invention that the rocking mechanism can be installed into a standard big game fishing chair with a minimum of inconvenience.

It is still another object of this invention to provide a number of adjustments for a big game fishing chair to allow the rocking mechanism to be utilized by operators of different stature and size.

It is yet another feature of this invention that the rocking mechanism can be locked to disable the rocking action at the discretion of the operator.

It is yet another advantage of this invention that the rocking action of the instant invention can be locked to prevent movement thereof while the big game fishing chair is not in use.

It is a further feature of this invention to provide an optional, alternative mounting holes for the rocker links of the rocker mechanism for selectively varying the rocking characteristics of the rocker mechanism.

It is a further object of this invention to provide a big game fishing chair which is durable in construction, inexpensive of manufacture, carefree of maintenance, facile in assemblage, and simple and effective in use.

These and other objects, features and advantages are accomplished according to the instant invention by providing a big game fishing chair that provides a rocking action to enhance the rod movement while fighting big game fish. The rocking action is controlled by the legs of the operator, which lessens fatigue. The rocking mechanism includes a casting that is supported on the rotational mount of a standard pedestal. The chair is supported on the casting by two pairs of front and rear pivot links that are angled toward one another to provide the desired pivotal action for the chair relative to the pedestal which is fixed to the boat deck. The rocking action supplied by the rocking mechanism, between a full rearward position and a full forward position, provides arcuate movement to the fishing rod with requiring any traditional movement supplied to the fishing rod through the pivotal movement of the rod holder. A locking mechanism is operable to fix the rocker mechanism in a non-pivoting configuration to prevent the rocking mechanism from being operable, thus disabling the rocking action while the chair is not in use.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
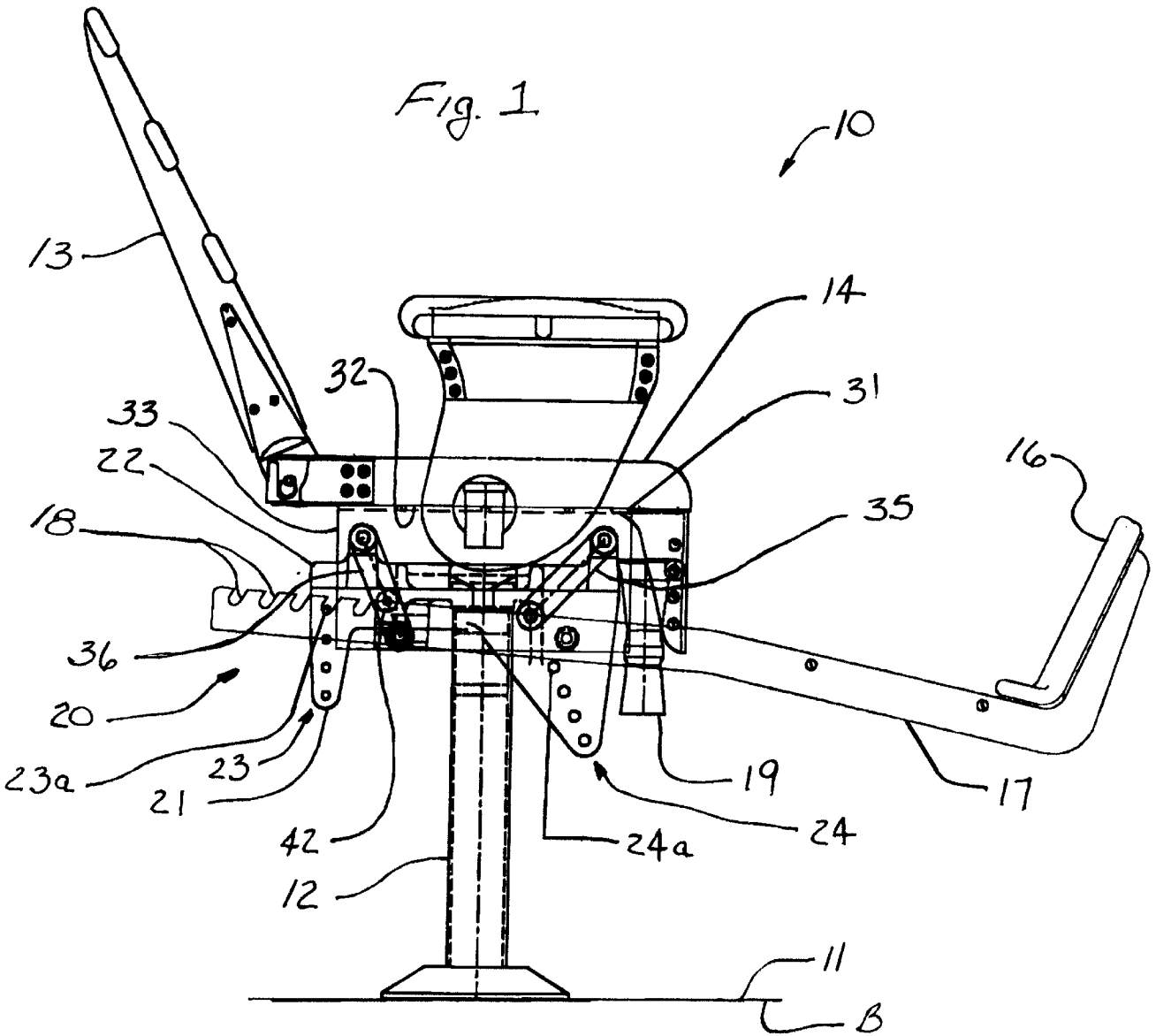
FIG. 1 is a schematic right side elevational view of the big game fishing chair incorporating the principles of the instant invention, a representative fishing rod being depicted in the pivoted rod holder.

Referring now to FIGS. 1–4 and FIGS. 12–16, a big game fishing chair 10 incorporating the principles of the instant invention can best be seen. Any left and right references are used as a matter of convenience and are determined by standing at the rear of the chair 10 behind the back rest 13 and facing the seat portion 14 and rod holder 19 supporting a fishing rod R at the forward portion of the chair 10. The big game fishing chair 10 is mounted to the deck 11 at the aft portion of a fishing boat B. The support pedestal 12 is preferably bolted to the deck 11 in a conventional manner facing the stem of the boat B to fish for big game fish, such as blue marlin, sailfish, swordfish, shark and the like in a customary manner.

Figure 2:
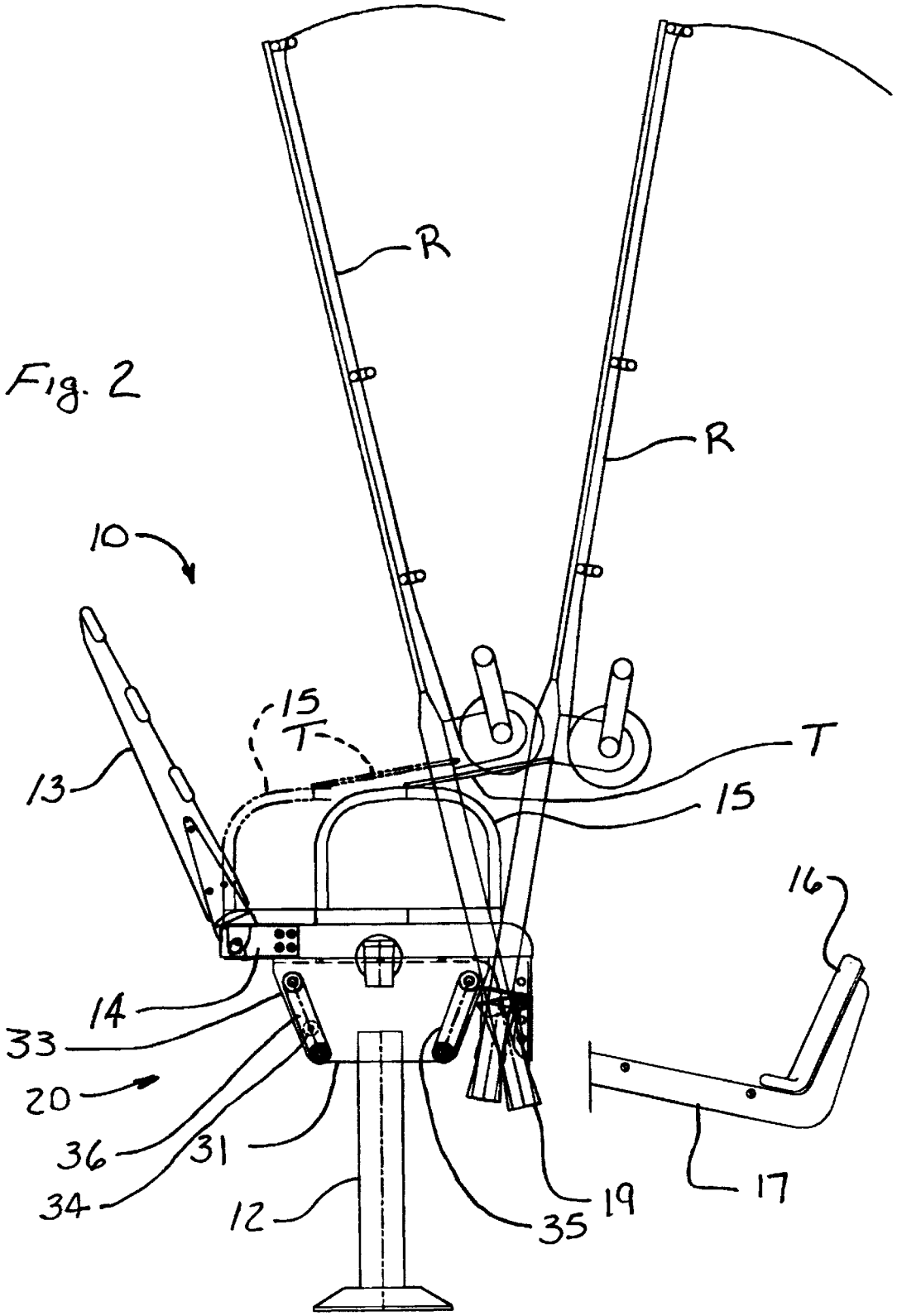
FIG. 2 is a partial schematic right side elevational view of the big game fishing chair, the foot rest and other portions of the chair being broken away for purposes of clarity, the sliding movement of the conventional bucket and of the associated fishing rod being depicted.

The big game fishing chair 10 is pivotally mounted to the top of the support pedestal 12 by a conventional bearing mechanism (not shown) to permit the entire chair assembly 10 to rotate about a generally vertically extending axis to permit the chair 10 to move with a big game fish caught on the fishing rod R. In a conventional big game fishing chair 10, the pivotal connection between the seat portion 14 of the chair 10 and the pedestal 12 provides the only freedom of movement permitted to the fisherman and to the chair. Additional movement is provided for between the chair 10 and the fisherman in the form of a "bucket" 15, a formed seat harness in which the fisherman sits and to which the fishing rod R is connected by ties T. The bucket 15 is free to slide over the surface of the seat portion 14 to allow the fisherman to move fore-and-aft by pushing with his feet against the foot rest 16. As best seen in the diagram of FIG. 2, the sliding movement of the bucket 15 effects a pivotal movement of the fishing rod R about the rod holder 19 due to the connection of the ties T between the fishing rod R and the bucket 15.

Additional pivotal movement of the fishing rod R can be accomplished through utilization of the fisherman's legs according to the principles of the instant invention. The sliding movement of the bucket 15 has been duplicated by complex fishing chairs within the prior art, but such devices are not adaptable to presently conventional fishing chairs. To be economically effective, this additional movement is preferably accomplished by modifying conventional fishing chairs. The imposition of a rocking mechanism 20 between the seat portion 14 and the pivotal support pedestal 12, will provide such additional movement. The rocking mechanism 20 includes a base member 21 pivotally mounted to the support pedestal 12 to provide the conventional swivel movement to the fishing chair 10, a mounting frame 31 attached to the seat portion 14 of the chair 10 and a set of rocker links 35, 36 interconnecting the base member 21 and the mounting frame 31 to allow relative movement therebetween, as will be described in greater detail below.

Figure 9:
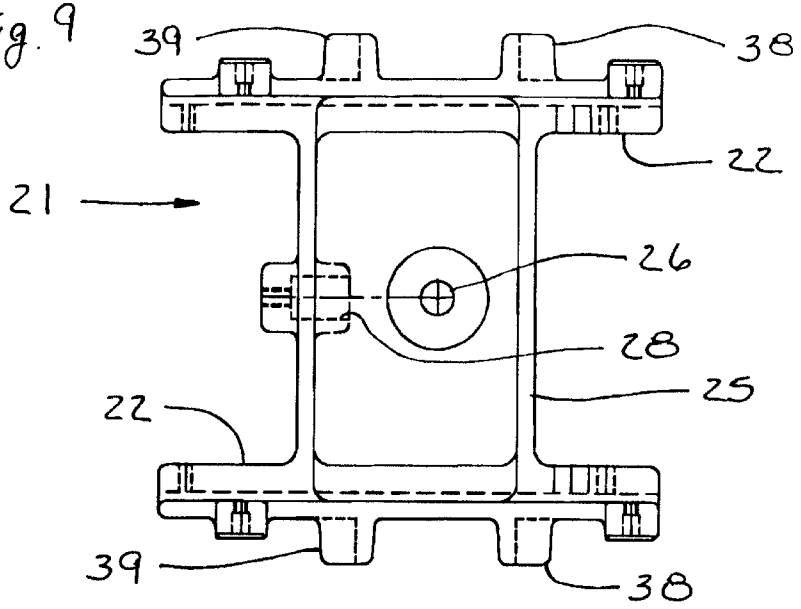
FIG. 9 is an enlarged top plan view of the cast base portion of the big game fishing chair.
Figure 11:
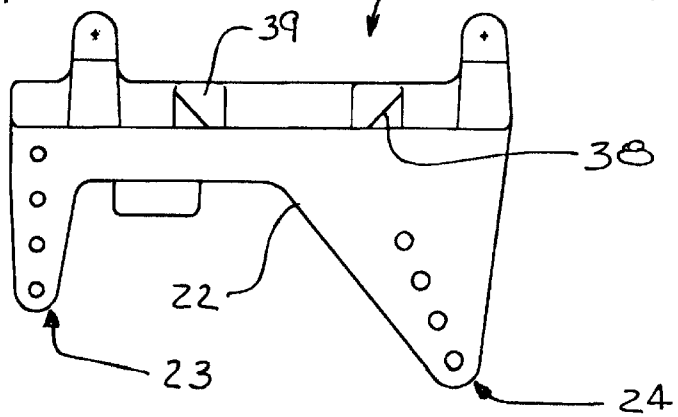
FIG. 11 is a right side elevational view of the cast base portion of FIG. 9.
Figure 10:
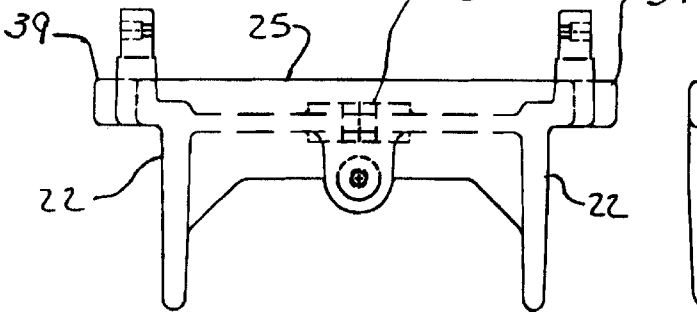
FIG. 10 is a rear elevational view of the cast base portion depicted in FIG. 9.
Figure 12:
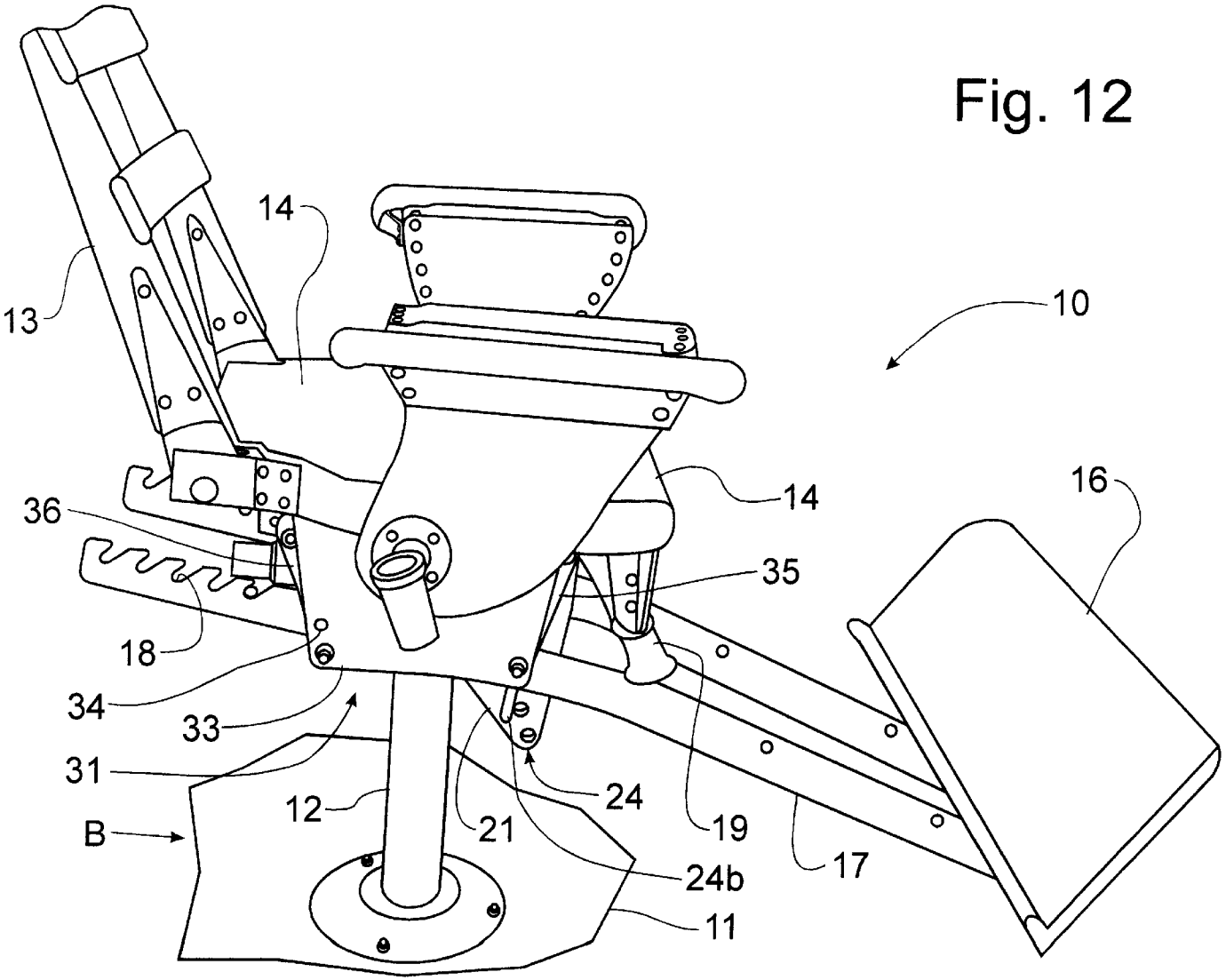
FIG. 12 is a right side perspective view of the big game fishing chair corresponding to the view of FIGS. 1 and 2.
Figure 13:
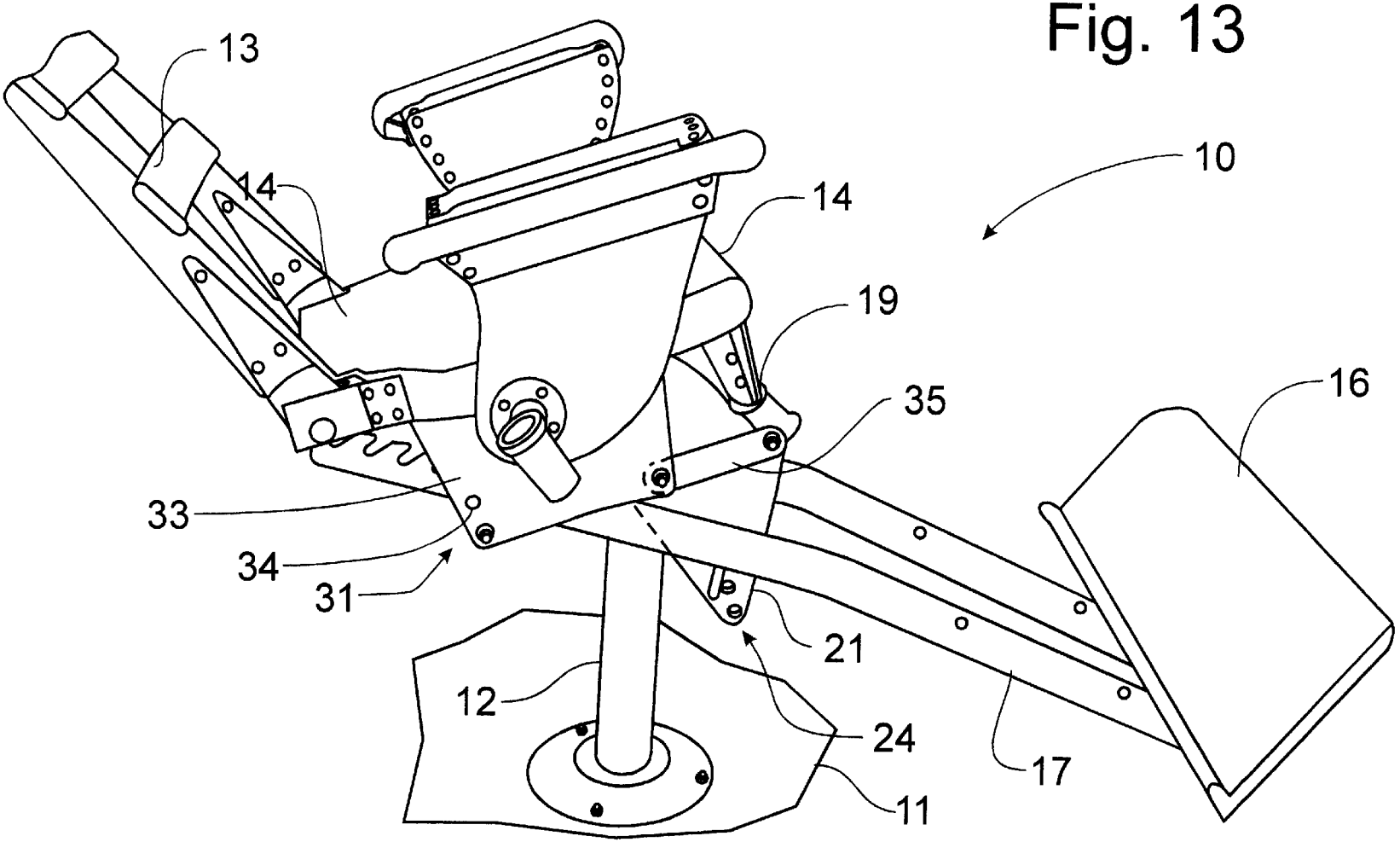
FIG. 13 is a right side perspective view of the big game fishing chair in the rearward rocked position corresponding to the view of FIG. 3.
Figure 14:
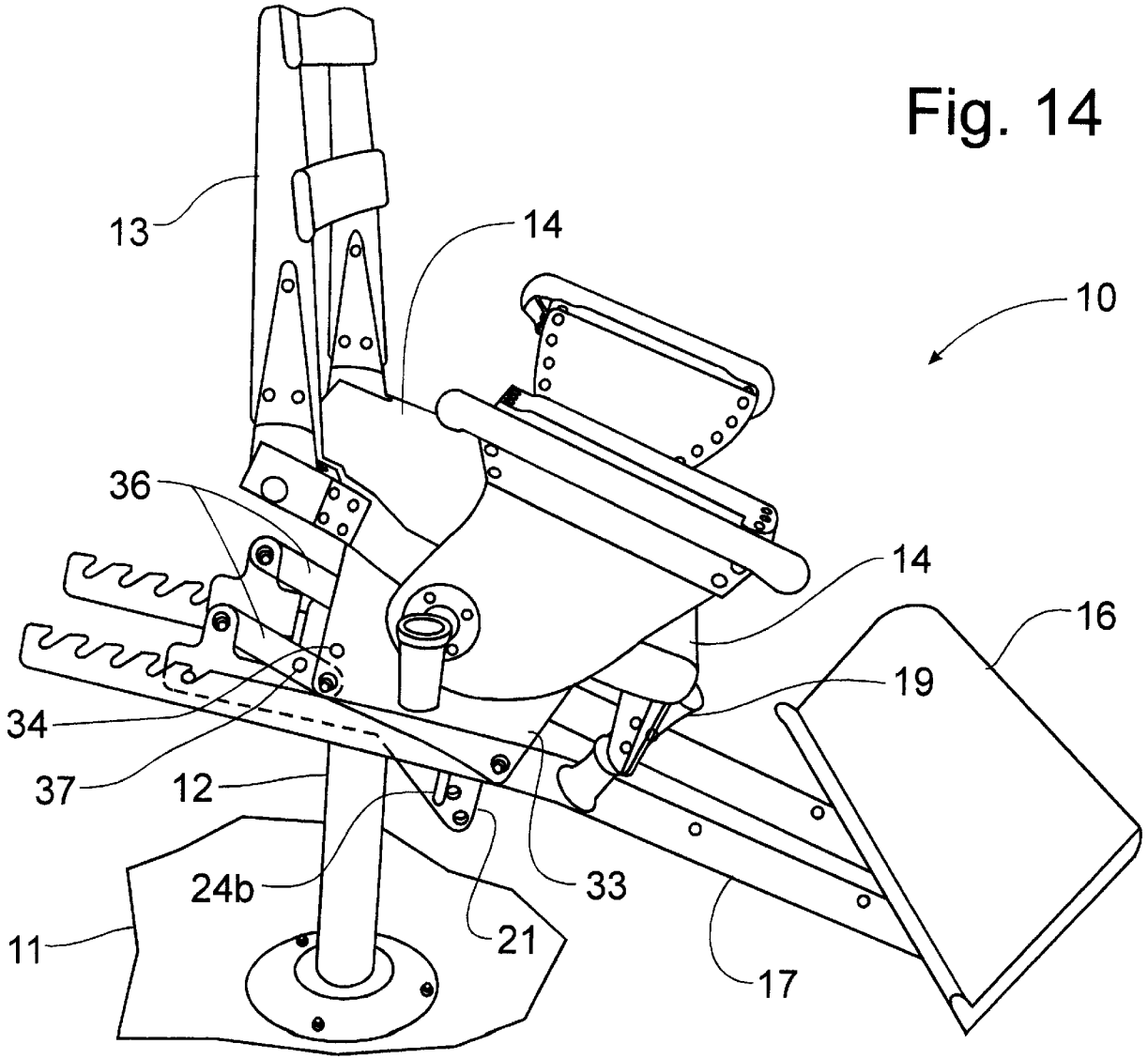
FIG. 14 is a right side perspective view of the big game fishing chair similar to that of FIGS. 12 and 13, but depicting the forward rocked position corresponding to the view of FIG. 4.
Figure 15:
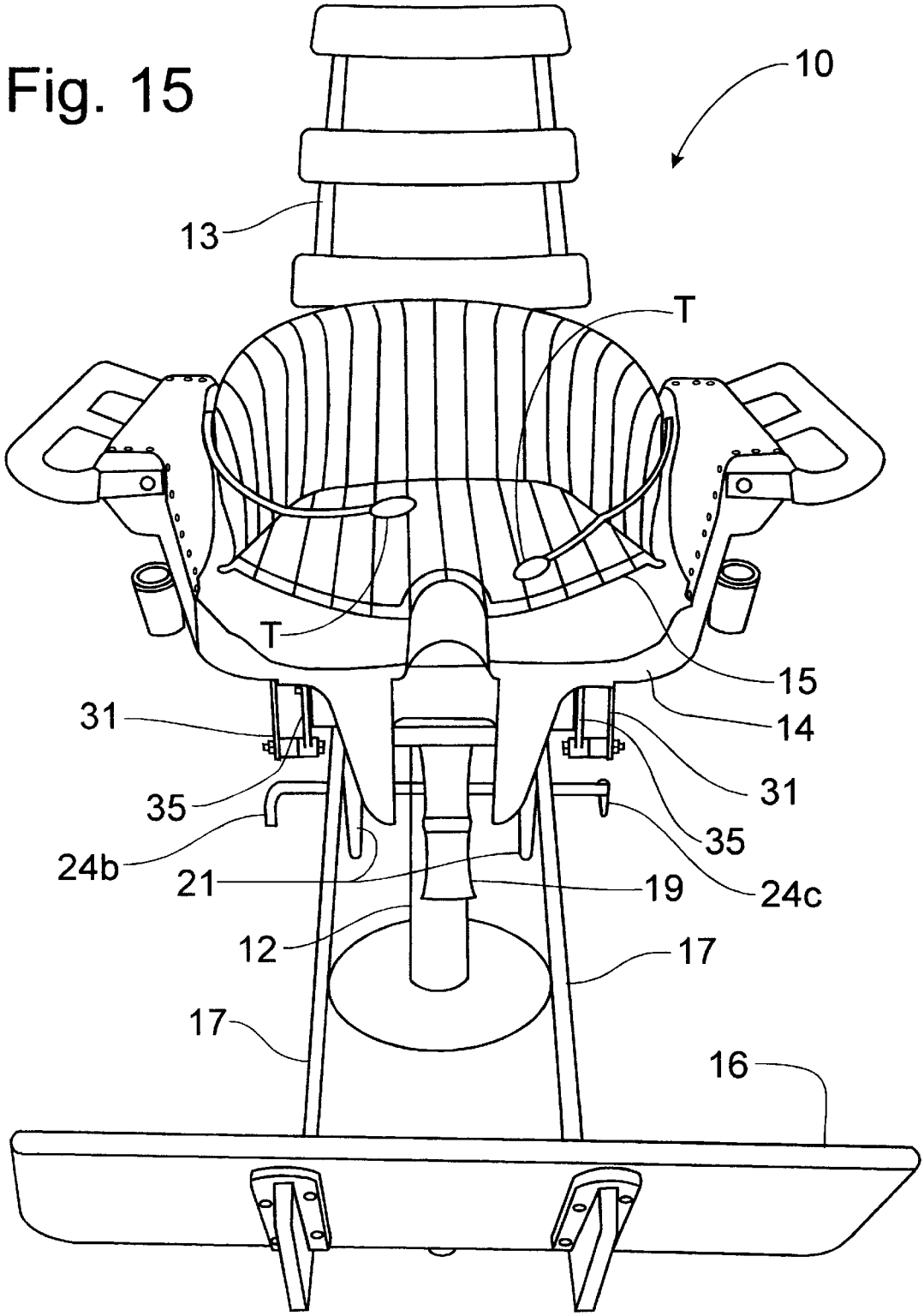
FIG. 15 is a front perspective view of the big game fishing chair shown in FIGS. 12–14, a bucket being placed on the seat of the chair to receive a fisherman, the rod holder is pivoted downwardly as the fishing rod has been removed for purposes of clarity.
Figure 16:
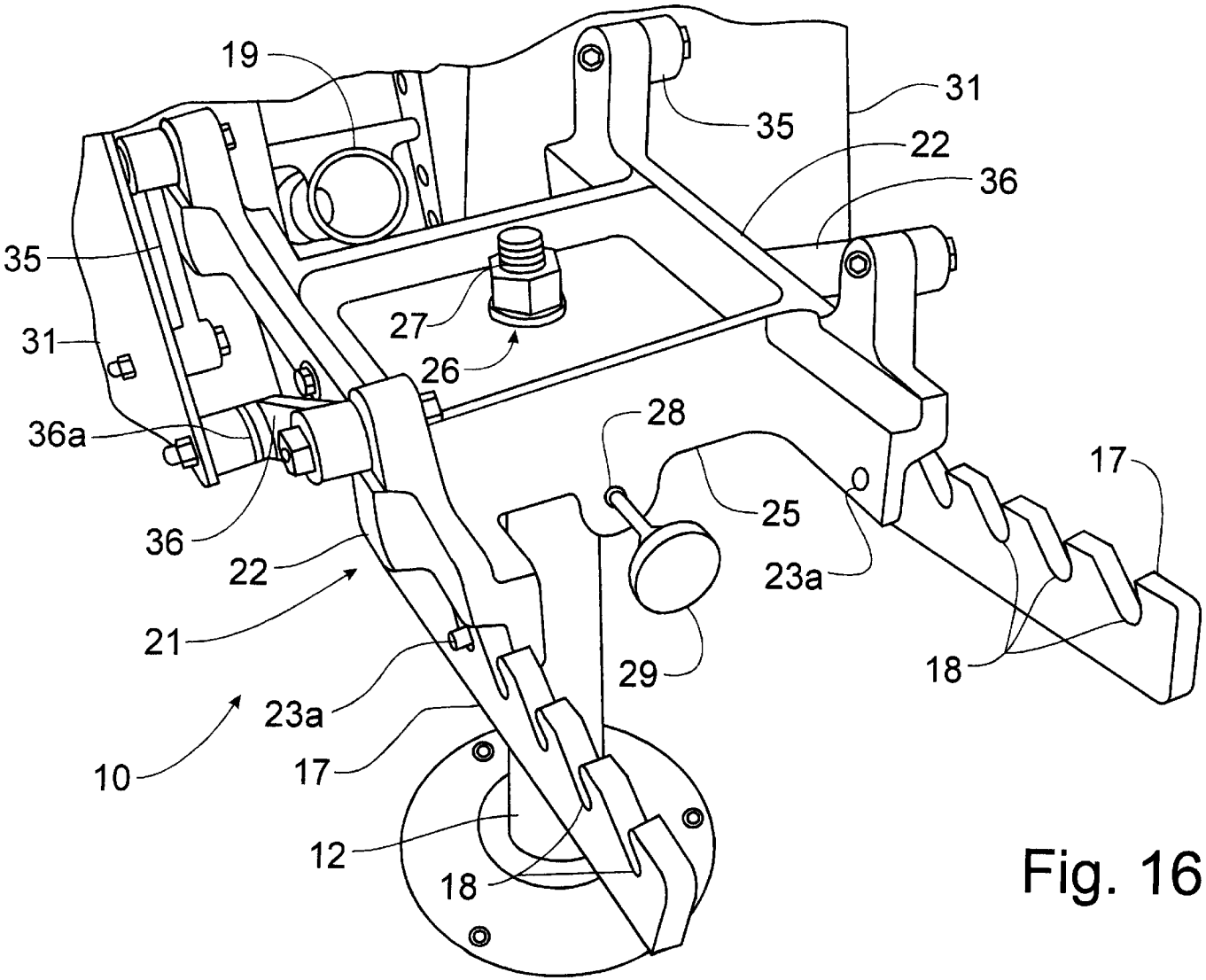
FIG. 16 is a left rear perspective view of an enlarged portion of the big game fishing chair to show the pivotal mounting of the base portion on the support pedestal and the mounting of the foot rest to the rear of the base portion.

The base member 21 is best seen in the enlarged detail views of FIGS. 9–11, but also as part of the chair 10 in substantially all of the drawings. The base member 21 is preferably formed as an aluminum casting, although other fabricated embodiments, such as a welded fixture, and other materials can also be operatively effective. The base member 21 is preferably formed with a pair of laterally spaced side portions 22, each of which is formed with a rear set of holes 23 arranged in a generally vertical pattern and a front set of holes 24 arranged in an inclined pattern. A central web 25 laterally interconnects the spaced side portions 22. The central web is formed with a single opening 26 oriented in a vertical manner to permit the passage of a mounting bolt 27 to connect the central web 25 and consequently the base portion 21 to a bearing assembly (not shown) in the support pedestal 12.

Accordingly, the base portion 21 is free to swivel in a generally horizontal plane about the generally vertical axis of the support pedestal 12. The central web 25 is also provided with a horizontally oriented opening 28 to receive a locking member 29 that can be manipulated to selectively engage the support pedestal 12 to prevent rotation of the base portion 21 relative thereto. The preferable configuration of the locking member 29 is one that will be threadably received within the opening 28 and have a compressible friction member (not shown) at the tip thereof to engage the surface of the support pedestal 12 and restrict movement through friction, as opposed to positively engaging holes in the support pedestal 12.

The mounting frame 31 is a formed member having a generally U-shaped configuration with the bight 32 thereof detachably connected to the seat portion 14 of the chair to become an integral part thereof and the legs 33 depending downwardly in general register with the side portions 22, but outside thereof. The legs 33 carry bosses at a lower extremity thereof to receive and pivotally support the rocker links 35, 36. The base member 31 is also provided with pivot supports to receive the rocker links 35, 36, as will be described in greater detail below. The rod holder 19 is pivotally supported on the front part of the seat portion 14 so that a fishing for R supported therein will move with the seat portion for reasons to be made clear below. Preferably, the front part of the chair is formed with a plurality of mounting holes through which a pivot pin connected to the rod holder 19 can be fastened to pivotally support the rod holder 19.

The foot rest 16 is carried by the base member 21. The foot rest 16 is constructed with a pair of laterally spaced mounting legs 17 with the foot rest 16 interconnecting the forward ends thereof. The mounting legs 17 are formed with a plurality of open slots 18 on the upper surfaces thereof. The foot rest 16 can then be detachably supported on the base member 21 by engaging a pin 23*a* positioned in a selected one of the rearward set of holes 23 and then resting on another pin 24*a* in a selected one of the forward set of holes 24. Since the majority of the weight of the foot rest assembly 16, 17 is forward of the pin 24*a,* the foot rest assembly 16, 17 pivots about the forward pin 24*a* and forces the slots 18 of the mounting legs 17 into engagement with the rearward pin 23*a*. The slots 18 keep the foot rest 16 from moving fore-and-aft.

Detachment of the foot rest, as for transport from one location to another, can be easily accomplished by raising the foot rest 16 at the forward end of the mounting legs 17 to disengage the rearward pins 23*a* from the slots 18 through a pivoting of the mounting legs 17 about the forward pins 24*a,* and then sliding the mounting legs 17 over top of the forward pins 24*a*. The multiple holes in both the rearward set 23 and the forward set 24 provide a multitude of positioning for the foot rest assembly 16, 17, not only vertically, but also in an inclined orientation, as one skilled in the art will readily realize. The plurality of slots 18 allow for a selective positioning of the foot rest 16 toward and away from the seat portion 14 to accommodate different leg lengths of the fisherman.

An alternative arrangement for mounting the foot rest assembly 16, 17 is shown in FIGS. 12–16. The rear portion of the base member 21 is provided with the pins 23*a* fixed therein on the opposing sides. A selected pair of the forward set of holes 24 is used to support a rod 24*b* that spans the gap between the opposing sides of the base member 21. The slotted rails 17 can then slide over top of the rod 24*b* until the rear pins 23*a* are aligned with a selected pair of slots 18 to position the foot rest 16 at the desired location to accommodate the size of the operator to be using the chair 10. The weight of the foot rest assembly 16, 17 can then be lowered to engage the rear pins 23*a* with the selected slots 18 and restrain the foot rest assembly 16, 17 at the desired location. The rod 24*b* is preferably formed with a cotter pin 24*c,* or the like, to prevent the rod 24*b* from accidentally disengaging the holes 24.

A set of four rocker links 35, 36 are connected to the bosses on the legs 33 of the mounting frame 31 and to the pivot supports of the base frame 21 and are positioned between the legs 33 of the mounting frame 31 and the base member 21 so that the rocker links 35, 36 are not exposed to the outer surface of the fishing chair 10. This pivotal connection permits a rocking movement of the mounting frame 31 relative to the base member 21; however, the pivotal connections are preferably assembled with at least one cupped, Belleville-type washer 36*a* on each rocker link 35, 36 to provide some resistance to the rocking motion.

The rocker links 35, 36 are preferably arranged so that in the central, non-rocked position, as depicted in FIGS. 1 and 2, the rocker links 35, 36 are somewhat symmetrical mirror images, as seen when comparing the front rocker links 35 to the rear rocker links 36. The pivotal connection of the rear rocker links 36 with the mounting frame 31 is forwardly of the pivotal connection of the rear rocker links 36 with the base member 21. Conversely, the front rocker links 35 have the pivotal connection with the mounting frame 31 rearward of the pivotal connection with the base member 21. This orientation of the rocker links 35, 36 provide the rocking motion to be described in greater detail below.

Figure 3:
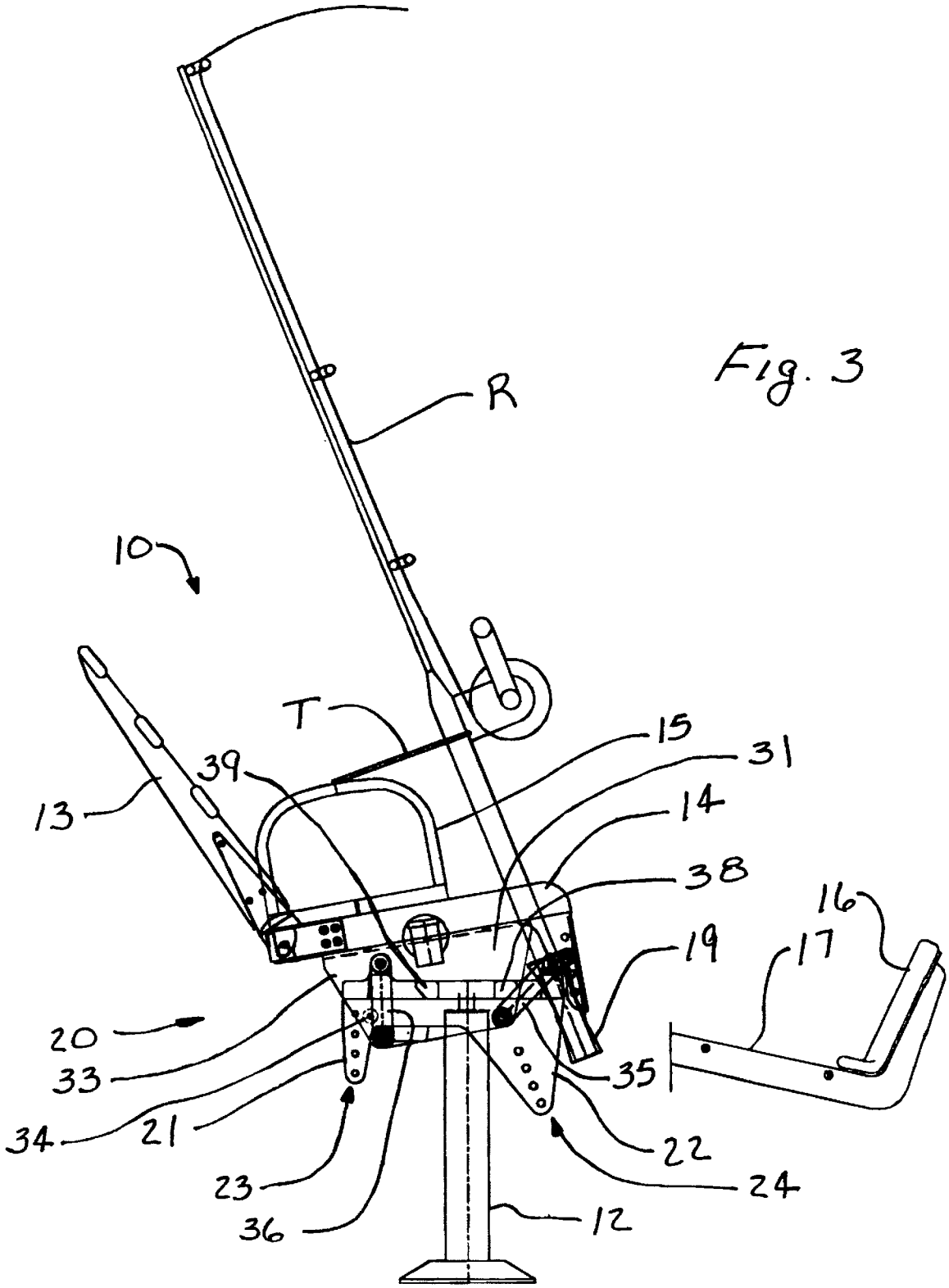
FIG. 3 is a schematic right side elevational view of the big game fishing chair shown in FIG. 2, but with the chair rocked rearward to pull the fishing rod rearwardly with the rocking motion of the chair, the bucket being moved to it rearward most position.

Since the foot rest 16 is fixed via the mounting legs 17 to the base member 21, an operator sitting on the seat portion 14 of the fishing chair 10 can push against the foot rest 16 with his/her feet through extension of his/her legs and effect a relative movement of the seat portion 14 about the pivotal linkage of the rocker links 35, 36. As demonstrated in FIG. 3, the rearward movement of the seat portion 14 causes the mounting frame 31 to move rearwardly taking the pivotal connections with the rocker links 35, 36. The rear rocker links 36, due to their orientation as described above, pass through a generally horizontally positioned arc segment which takes the rear of the seat portion 14 and back rest 13 generally horizontally rearwardly. The front rocker links 35, however, must move through a generally vertical arc segment due to the orientation thereof causing the front of the seat portion 14 to move vertically relative to the back rest 13. This combined movement of the rocker links 35, 36 tips the seat portion backwardly and effects an exaggerated movement of the fishing rod R, as depicted in FIG. 3. This movement corresponds to a substantial pulling on the fish to urge the hooked fish toward the boat B, without using any arm motion of the operator at all.

Figure 4:
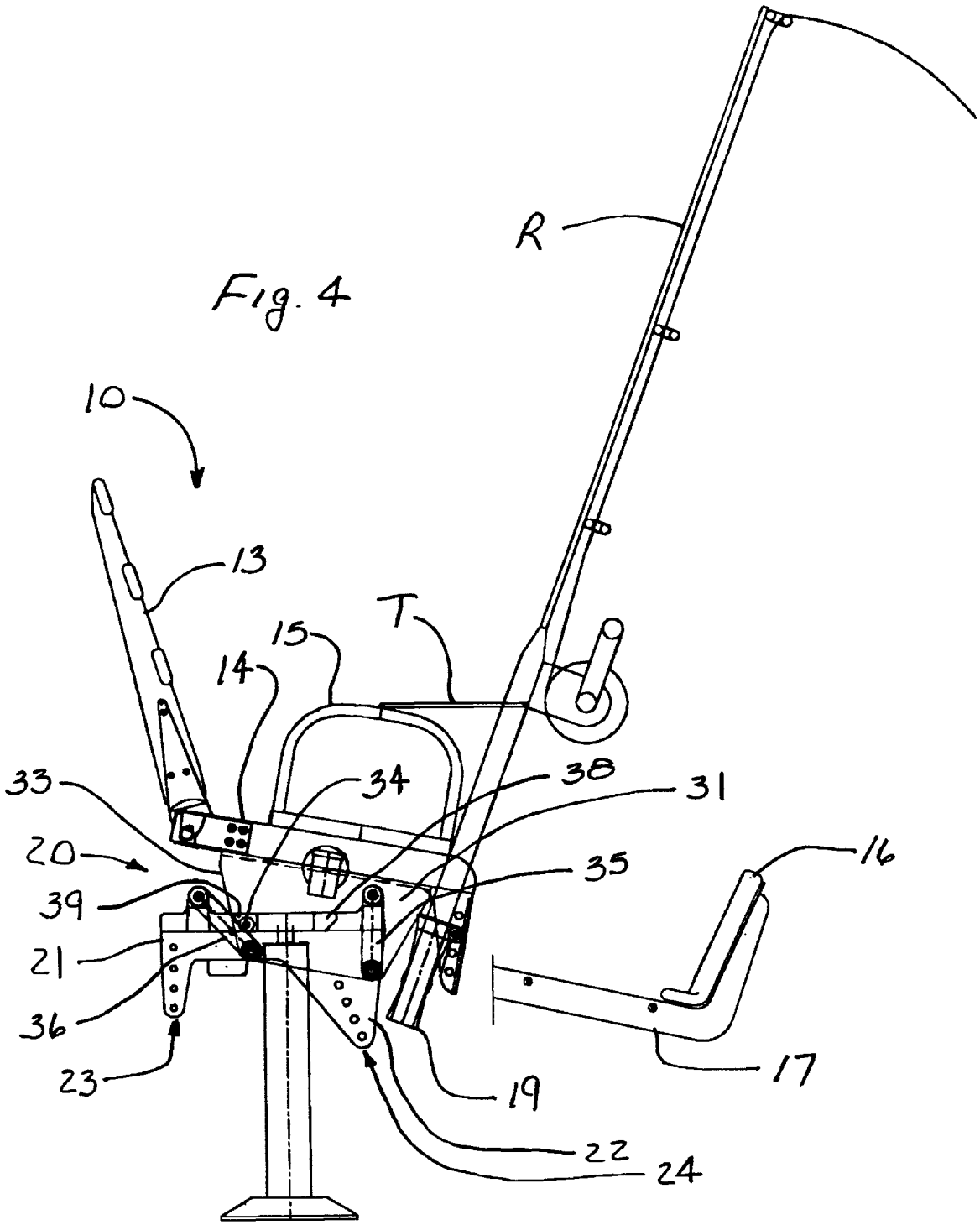
FIG. 4 is a schematic right side elevational view of the big game fishing chair shown in FIG. 2, but with the chair rocked forward to allow the fishing rod to arc forwardly with the rocking motion of the chair, the bucket being moved to a forward position on the chair.
Figure 6:
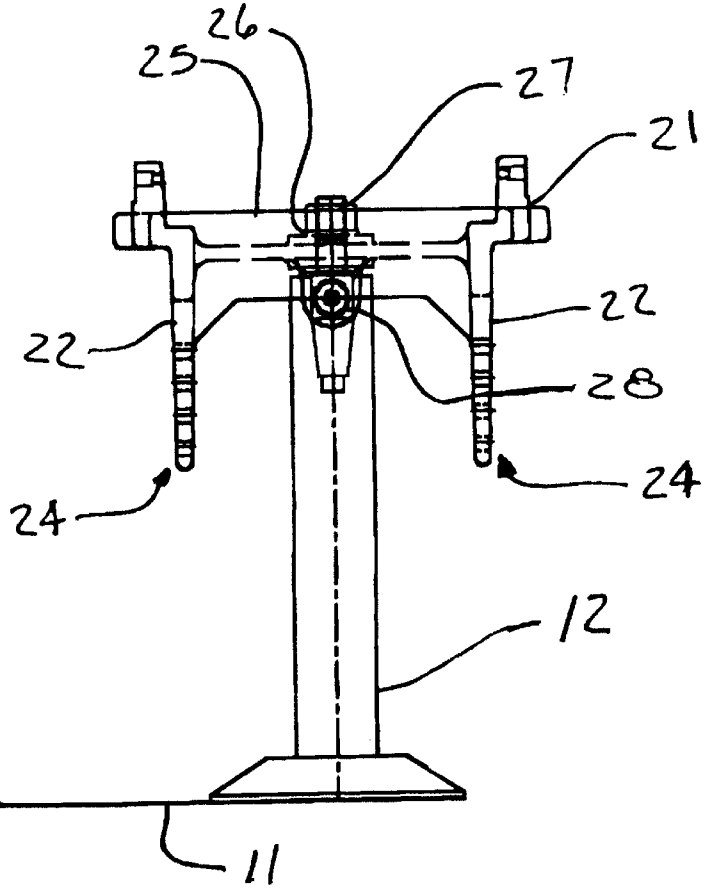
FIG. 6 is a front elevational view of the base portion of the big game fishing chair depicted in FIG. 5.
Figure 5:
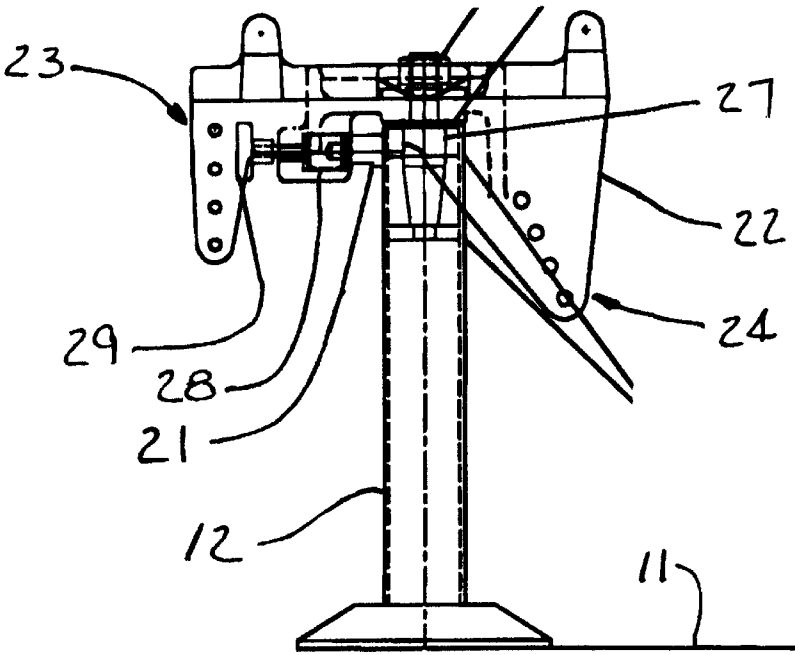
FIG. 5 is a schematic right side elevational view of the base portion of the big game fishing chair shown in FIG. 1 mounted on the pedestal.
Figure 8:
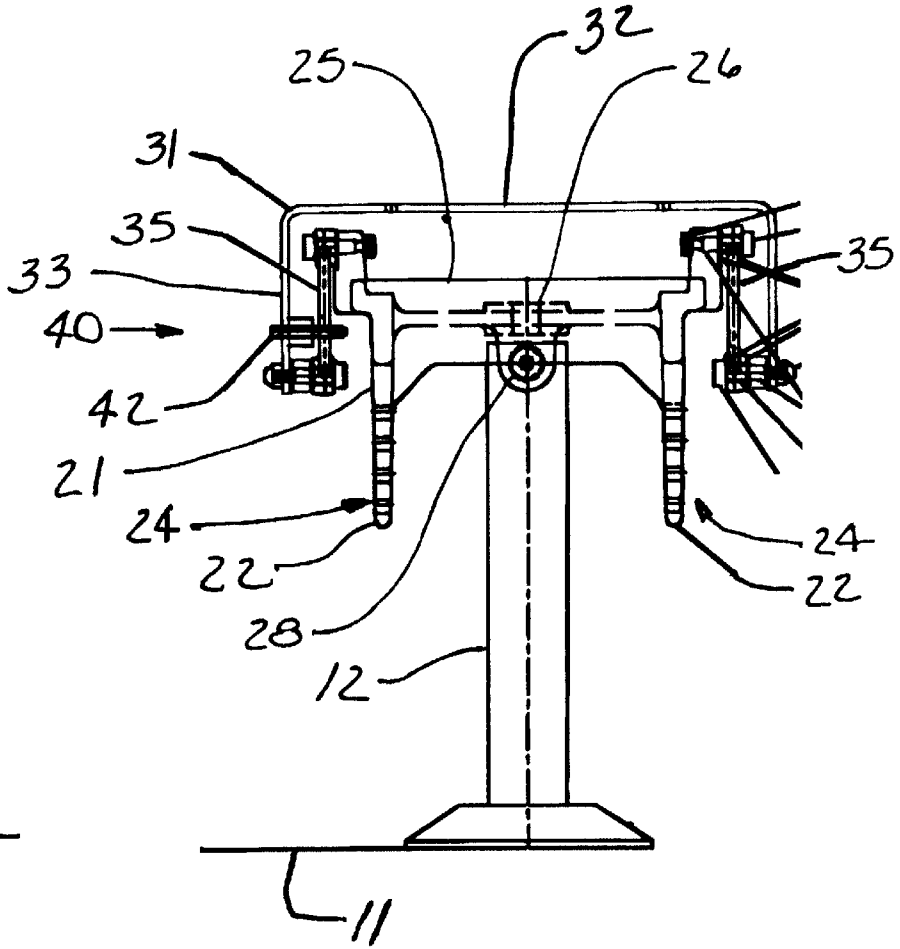
FIG. 8 is a schematic front elevational view of the base portion of the big game fishing chair, similar to that of FIG. 6, but with the rocker assembly mounted to the base portion, as depicted in FIG. 7.

Conversely, a bending of the operator's legs to allow the force of the hooked fish fighting on the fishing rod R to move the seat portion 14 forwardly effects an exaggerated movement of the fishing rod R forwardly to give the hooked fish some play before pulling rearwardly again. With particular reference to FIG. 4, one skilled in the art will readily see that the movement of the rocker links 35, 36 from the central position shown in FIG. 2 causes the opposite movement of the seat portion 14 of the chair 10 from the rearward movement. The orientation of the rocker links 35, 36 is such that the forward movement of the mounting frame 31 and attached seat portion 14 causes the front part of the seat portion to move in a generally horizontal arc segment while the rear rocker links 36 move through a somewhat vertically inclined arc segment to cause the seat portion 14 to tip forwardly and effect an exaggerated movement of the fishing rod R.

Figure 7:
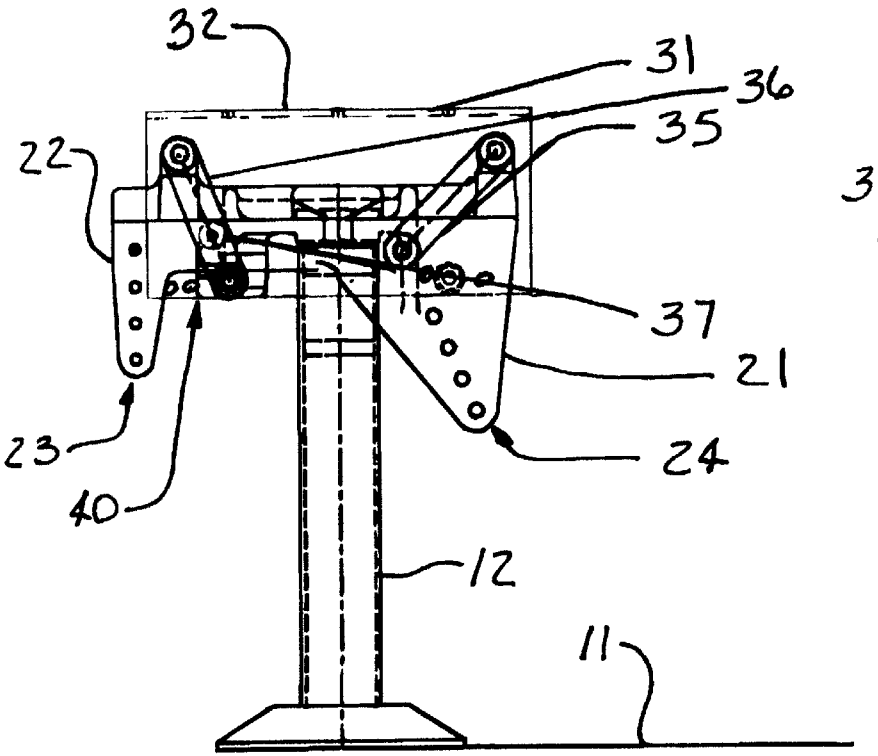
FIG. 7 is a schematic right side elevational view similar to that of FIG. 5, but with the rocker assembly mounted to the base portion, optional alternative mounting holes are representatively shown.

An alternative configuration of the mounting frame 31 would provide optional mounting holes, as depicted in FIG. 7, for the attachment of the rocker links 35, 36 thereto to change the rocking characteristics of the rocking assembly 20 and/or the orientation of the seat 14 in the central non-rocked position, as well as the forward and rearward fully rocked positions. For example, by re-positioning the rocker links 35, 36 into a parallel orientation, the movement of the seat 14 during the rocking action would be equivalent to a sliding connection, as the parallel links would operate as a four-bar linkage to maintain the seat 14 in a fixed orientation throughout the movement thereof fore-and-aft. Although such a parallel orientation of the rocker links 35, 36 would not provide the exaggerated rocking action, as described above, such rocking action can be lessened or minimized at the election of the operator when setting up the chair 10.

The base member 21 is preferably formed with front and rear stop members 38, 39 on the opposing side portions 22. The stop members 38, 39 are engageable with the rocker links 35, 36 to limit the amount of pivotal movement of the seat portion 14 and attached mounting frame 31 relative to the base member 21. When the seat portion 14 is rocked rearwardly, the front rocker links 35 engage the front stop members 38 to prevent the tipping of the seat portion rearwardly more than a predetermined amount, preferably corresponding to about 10 degrees of arcuate movement of the fishing rod R from the central, non-rocked position shown in FIG. 2. Similarly, the tipping of the seat portion 14 forwardly causes the rear rocker links 36 to engage the rear stop members 39 and limit the forward tipping of the seat portion 14 to a predetermined amount, again preferably corresponding to about 10 degrees of arcuate movement of the fishing rod R from the central, non-rocked position shown in FIG. 2.

The movement of the fishing rod R as a result of the rocking of the seat portion 14 is cumulative to the movement of the fishing rod R caused by the fore-and-aft sliding movement of the bucket 15 over the top surface of the seat portion 14. Generally, the sliding movement of the bucket 15 can effect an angular movement of the fishing rod through an arc of approximately 20 degrees. Adding the exaggerated angular movement of the fishing rod R due to the rocking motion of the seat portion 14 to the movement associated with the sliding motion of the bucket 15 can result in a total arcuate motion of the fishing rod through an angle of approximately 40 degrees, all without the utilization of the operator's arms.

In the event that the rocking motion of the seat portion 14 is not desired, the rocking assembly 20 is provided with a locking mechanism 40. To prevent the rocking assembly 20 from moving, a locking pin 42 can be inserted through an appropriately placed opening 34 in one of the legs 33 of the mounting frame 31 and engage a hole 37 in one of the rocker links 35, 36 passing in register therewith. The holes 34, 37 in the leg 33 and the corresponding rocker link 35, 36 are arranged so that the locking pin 42 interengaging the holes 34, 37 and preventing relative movement therebetween locks the rocking mechanism 20 in the central, non-rocked position shown in FIG. 2. The locking pin 42 is preferably of the quick disconnect variety that incorporates a spring detent to permit the rapid engagement and disengagement of the locking pin from the holes 34, 37. One skilled in the art will readily realize that the rapid engagement of the rocking mechanism 20 is sometimes desirable when a big game fish is hooked, whereas the rocking motion may not be desired when the fishing chair 10 is not in active usage.

Accordingly, one skilled in the art will readily recognize that a novel fish fighting chair 10 is provided to enhance the use of the operator's leg muscles in fighting a big game fish. Arcuate movement of the fishing rod R can be effected via the use of the operator's legs through both a sliding movement of the bucket 15 over the top surface of the seat portion 14 and also through the rocking motion of the seat portion 14 relative to the base member 21. The seat portion, and the operator sitting therein, can still swivel about the upright axis of the support pedestal 12 to stay in line with the hooked fish as it moves beneath the surface of the water, while rocking and sliding motions are achieved simultaneously in alignment with the hooked fish. The rocking mechanism 20 can be quickly and easily converted between a conventionally operable fishing chair 10 and an enhanced rocking fishing chair 10 through manipulation of the locking pin 42.

A standard, presently conventional chair can be easily converted to the enhanced rocking fishing chair. The seat portion 14 need only be disconnected from the support pedestal 12 and the rocking mechanism 20 interposed therebetween to convert the standard fishing chair to an enhanced rocking fishing chair 10. The mounting frame 31 will be fastened to the seat portion 14, while the base member 21 is pivotally fastened to the support pedestal 12 in lieu of the conventional seat portion 14. The provision of the rocker links 35, 36 between the mounting frame 31 and the base member 21 will provide the desired rocking motion without sacrificing any other motion associated with the standard fishing chair, including the sliding motion of the bucket 15 over top of the seat portion 14 and the swivel motion of the chair 10 relative to the support pedestal 12.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A big game fishing chair for mounting on a deck of a boat on which an operator can sit to fight big game fish, comprising:

a support pedestal adapted to be fastened to said deck;

a chair seat supported on said pedestal; and a rocking mechanism including front and rear pivot linkage mechanisms interconnecting said pedestal support and said seat member to permit said chair seat to move in a pivotal rocking motion relative to said pedestal between a rearward rocked position and a forward rocked position.

2. The big game chair of claim 1 wherein said support pedestal is provided with a rotational mechanism that enable said chair seat to be rotated about a generally vertical axis, said rocking mechanism being supported on said rotational mechanism to permit said rocking motion to be aligned with said big game fish.

3. The big game fishing chair of claim 2 wherein said rocking mechanism further includes:

a base member connected to said rotational mechanism to permit rotation thereof about said generally vertical axis;

a mounting frame affixed to said chair seat and being formed with laterally opposing, downwardly depending legs;

said front pivot linkage mechanism interconnecting said downwardly depending legs and said base member; and said rear pivot linkage mechanism interconnecting said downwardly depending legs and said base member.

4. The big game fishing chair of claim 3 wherein said big game fishing chair further comprises:

a foot rest supported on adjustable mounting rails, said base member being engageable with said mounting rails to permit said foot rest to be positioned relative to said chair seat for proper positioning of said foot rest to accommodate the size of the operator.

5. The big game fishing chair of claim 4 wherein said base member includes:

a central web fixed to said rotational mechanism;

a pair of front support towers projecting upwardly from said central web;

a pair of rear support towers projecting upwardly from said central web; and a pair of downwardly extending forward mounting arms having mounting holes therein for connection to said adjustable rails for support thereof from said base member.

6. The big game fishing chair of claim 5 wherein said front and rear pivot linkages include a pair of front links and a pair of rear links, respectively, interconnecting said downwardly depending legs of said mounting frame and the corresponding said support towers, said front being angled downwardly and rearwardly toward the corresponding said rear links, said rear links being angled downwardly and forwardly toward the corresponding said front links to provide said rocking motion.

7. The big game fishing chair of claim 6 wherein said rocking mechanism supports a locking apparatus that prevents relative pivotal movement between said mounting frame and said front and rear pivot linkages to restrain said chair seat from said rocking motion.

8. A fishing chair comprising:

a seat member;

a support member for positioning said seat member in an elevated position; and a rocking mechanism connected to said support member and supporting said seat member on a pair of front links and a pair of rear links arranged to provide a rocking motion to said seat member relative to said support member.

9. The fishing chair of claim 8 wherein said rocking mechanism further includes a base member comprising:

a central web connected to said support member;

a pair of forward mounting towers pivotally connecting said pair of front links; and a pair of rearward mounting towers pivotally connecting said pair of rear links.

10. The fishing chair of claim 9 wherein said seat member is movable between a rearward rocked position and a forward rocked position with a central position therebetween, the corresponding said front and rear links being angled downwardly and toward one another when in said central position to provide said rocking motion.

11. The fishing chair of claim 10 wherein said base member further comprises a pair of rail support arms engageable with adjustable rails supporting a foot rest, said adjustable rails being formed with open slots to permit engagement with said base member at variable positions to locate said foot rest relative to said seat member to accommodate an operator.

12. The fishing chair of claim 11 wherein said rocking mechanism is provided with a locking mechanism selectively engageable to lock out said rocking motion.

13. The fishing chair of claim 12 wherein said support member includes a rotation mechanism upon which said base member is mounted to permit rotational movement of said seat member while aligning said rocking motion in a desired orientation.

14. The fishing chair of claim 12 wherein said seat member is provided with a pair of laterally opposing downwardly depending legs connected to said front and rear links, said locking mechanism being a detachable pin interengaging a hole in one of said downwardly depending legs and an alignable hole in a selected one of said links to prevent relative pivotal movement between said links and said seat member, thereby preventing said rocking motion.

15. In a big game fishing chair mountable on a deck of a boat from which an operator can fight big game fish, said fishing chair having a pedestal support on which a seat member can be rotatably mounted for rotational movement about a generally vertical axis, the improvement comprising:

a rocking mechanism interposed between said pedestal support and said seat member to provide a rocking motion to said seat member between a rearward rocked position and a forward rocked position, said rocking mechanism being configured to return said seat member to a central non-rocked position between said rearward rocked position and said forward rocked position when no external forces are being exerted thereon.

16. The big game fishing chair of claim 15 wherein said rocking mechanism comprises:

a base member supported on said pedestal support for rotation about said generally vertical axis, said base member including:

a pair of forward mounting towers; and a pair of rearward mounting towers;

a mounting frame attached to said seat member to be affixed thereto, said mounting frame having a pair of laterally opposed, downwardly depending legs;

a pair of front links pivotally interconnected, respectively, to said forward mounting towers and to a corresponding forward portion of said downwardly depending legs; and a pair of rear links pivotally interconnected, respectively, to said rearward mounting towers and to a corresponding rearward portion of said downwardly depending legs.

17. The big game fishing chair of claim 16 wherein said front links are oriented downwardly and toward the corresponding said rear link, when said seat member is in said central position, and said rear links are correspondingly oriented downwardly and forwardly toward the corresponding said front link to provide said rocking action and to return said seat member into said central position when no external forces are exerted thereon.

18. The big game fishing chair of claim 17 wherein said base member has a pair of downwardly extending support arms having a plurality of aligned holes therein for selectively supporting a pair of mounting rails, said base member further having a pair of support pins engageable with corresponding open slots in said mounting rails to provide an adjustable mounting of a foot rest supported on said mounting rails to the convenience of the operator.

19. The big game fishing chair of claim 18 wherein said base member further comprises a locking mechanism selectively engageable between said mounting frame and one of said links to lock out said rocking action by preventing pivotal movement between said links and said mounting frame.

20. The big game fishing chair of claim 19 wherein said downwardly depending legs are provided with alternative mounting holes for the attachment of said front and rear links thereto to change the characteristics of said rocking action.

21. A rocking mechanism for use with a fishing chair mounted on a support member to position a seat member in an elevated position to provide a rocking motion for said seat member, comprising:

a base member connectable to said support member;

a mounting frame connectable to said seat member;

a pair of front links pivotally interconnecting said base member and a forward portion of said mounting frame;

a pair of rear links pivotally interconnecting said base member and a rearward portion of said mounting frame, said rear links being oriented in a downwardly and forwardly configuration while said front links are oriented in a downwardly and rearwardly configuration to provide said rocking motion to said seat member.

22. The rocking mechanism of claim 21 wherein said base member includes a pair of front mounting towers and a pair of rear mounting towers for pivotally connecting said front and rear links, respectively.

23. The rocking mechanism of claim 22 further comprising a locking mechanism selectively engageable between a selective one of said links and said mounting frame to prevent relative pivotal movement therebetween and, thereby, restrain said rocking motion.

24. The rocking mechanism of claim 23 wherein said mounting frame is formed with a pair of laterally opposed legs extending downwardly from said seat member, said front and rear links being connected to said legs through selected ones of a plurality of mounting holes formed in said legs to provide a selectable rocking characteristic to said rocking mechanism.

* * * * *